US007186932B2

(12) United States Patent
Ishii et al.

(10) Patent No.: US 7,186,932 B2
(45) Date of Patent: Mar. 6, 2007

(54) SWITCH DEVICE

(75) Inventors: Takashi Ishii, Osaka (JP); Masashi Fujimoto, Osaka (JP); Shigetoshi Fujitani, Osaka (JP); Takayuki Sakai, Osaka (JP); Atsushi Matsumoto, Osaka (JP); Takao Fukui, Osaka (JP)

(73) Assignee: Idec Izumi Corporation, Osaka (JP)

( * ) Notice: Subject to any disclaimer, the term of this patent is extended or adjusted under 35 U.S.C. 154(b) by 0 days.

(21) Appl. No.: 10/526,658

(22) PCT Filed: Sep. 4, 2003

(86) PCT No.: PCT/JP03/11325

§ 371 (c)(1),
(2), (4) Date: Mar. 3, 2005

(87) PCT Pub. No.: WO2004/023501

PCT Pub. Date: Mar. 18, 2004

(65) Prior Publication Data

US 2005/0284742 A1 Dec. 29, 2005

(30) Foreign Application Priority Data

Sep. 9, 2002 (JP) ..... 2002-262887

(51) Int. Cl.
*H01H 27/06* (2006.01)

(52) U.S. Cl. ..... 200/43.08; 200/43.11

(58) Field of Classification Search ..... 200/293–296, 200/310–314, 341–345, 43.16, 43.11, 43.12, 200/43.13

See application file for complete search history.

(56) References Cited

U.S. PATENT DOCUMENTS

| | | | | |
|---|---|---|---|---|
| 4,431,879 | A * | 2/1984 | Fujita et al. | 200/314 |
| 4,434,339 | A * | 2/1984 | Ohashi | 200/295 |
| 4,496,813 | A * | 1/1985 | Fukushima | 200/314 |
| 4,933,523 | A * | 6/1990 | Honda et al. | 200/526 |
| 5,055,642 | A * | 10/1991 | Miyata | 200/293 |
| 5,059,754 | A * | 10/1991 | Kaichi et al. | 200/332.1 |
| 5,345,051 | A * | 9/1994 | Miike | 200/345 |
| 6,198,058 | B1 * | 3/2001 | Graninger et al. | 200/50.02 |

FOREIGN PATENT DOCUMENTS

| | | |
|---|---|---|
| JP | 9-8525 | 6/1934 |
| JP | U.M. 8525 | 6/1934 |
| JP | 9-14836 | 11/1934 |
| JP | 37-25337 | 9/1962 |
| JP | 49-23775 | 2/1974 |
| JP | 49-91767 | 8/1974 |
| JP | 49-145167 | 12/1974 |

(Continued)

*Primary Examiner*—Michael Friedhofer
*Assistant Examiner*—Lisa Klaus
(74) *Attorney, Agent, or Firm*—Jordan and Hamburg LLP

(57) ABSTRACT

When an operator applies a removing force to turn a switch portion b in a direction C2, a projection a4 abuts against a slope b71 so that the removing force as a reaction is applied to the slope. The removing force is divided into a component working along the slope b71 and a component F working in a same direction as a center axis X. Thus, the removing force is converted into a force F in the same direction as the center axis X. By means of the force F in the same direction as the center axis X, a pushbutton support b6 is moved downward as accordingly moving a movable contacts b9 away from a fixed contacts b12 via a contact shaft b5.

20 Claims, 6 Drawing Sheets

FOREIGN PATENT DOCUMENTS

| | | |
|---|---|---|
| JP | 51-36077 | 3/1976 |
| JP | 58-142826 | 9/1983 |
| JP | 01-241723 | 9/1989 |
| JP | 1-174826 | 12/1989 |
| JP | 03-145024 | 6/1991 |
| JP | 6-131946 | 5/1994 |

* cited by examiner

SWITCH DEVICE

BACKGROUND

The present invention relates to a switch device wherein an operation portion and a switch portion are free to be mounted to or dismounted from each other.

There have conventionally been known a switch device wherein the operation portion is free to be mounted to or dismounted from the switch portion (also referred to as a contact portion or a contacting portion) (see, for example, FIG. 8 in Japanese Unexamined Patent Publication No. 1-241723). Such a switch device includes a pushbutton switch wherein one or more pairs of contacts in the switch portion are separated off from each other (opened) in a state where the operation portion is dismounted from the switch portion. This type of switch is applied to, for example, an emergency stop pushbutton switch.

However, there may be a problem that if overcurrent or the like causes one or more pairs of contacts to be fused to each other, the contacts may be held in contact with each other even though the operation portion is dismounted from the switch portion. In a case where the switch device is applied to the emergency stop pushbutton switch, for example, the following problem may be encountered. If a pair of contacts are in contact with each other despite the operation portion dismounted from the switch portion, machine tools as an operation object is in an operative condition.

The invention has been accomplished to solve the above problem and has an object to provide a switch device which ensures that even if one pair of contacts are fused to each other, the contacts can positively be separated off from each other when the operation portion and the switch portion are dismounted from each other.

DISCLOSURE OF THE INVENTION

The switch device according to the invention for achieving the above object has an arrangement wherein an operation portion externally operated and a switch portion are free to be mounted to or dismounted from each other, the switch portion including a first contact and a second contact allowed to be brought into or out of contact with each other, and is characterized in that a removing force externally applied for dismounting the operation portion and the switch portion from each other acts to separate the first contact and the second contact off from each other.

According to the invention thus arranged, the externally applied removing force separates the first contact and the second contact off from each other and hence, it is ensured that the first contact and the second contact can positively be separated off from each other in a state where the operation portion and the switch portion are dismounted from each other.

The switch device may have an arrangement wherein the operation portion comprises a pushbutton which, when receiving an operating force externally applied thereto for opening or closing the first contact and the second contact, moves to transmit the operating force to the switch portion thereby effecting the opening or closing of the contacts, and wherein the removing force is applied by turning either one of the operation portion and the switch portion about a moving direction of the pushbutton.

According to the invention thus arranged, the arrangement of the switch device may be simplified and downsized because the removing force is applied by turning either one of the operation portion and the switch portion about the moving direction of the pushbutton.

The switch device may have an arrangement wherein either one of the first contact and the second contact is designed to be movable in the switch portion, wherein the operation portion comprises a pushbutton which, when receiving an operating force externally applied thereto for opening or closing the first contact and the second contact, moves to transmit the operating force to the movable one of the first contact and the second contact thereby effecting the opening or closing of the contacts, and wherein the removing force is applied by turning either one of the operation portion and the switch portion about a moving direction of the pushbutton.

According to the invention thus arranged, the arrangement of the switch device may be simplified and downsized because the removing force is applied by turning either one of the operation portion and the switch portion about the moving direction of the pushbutton.

The switch device may have an arrangement further comprising converting means for converting the removing force into a force working in the same direction as the operating force and transmitting the resultant force to the switch portion.

According to the invention thus arranged, the arrangement of the switch device may be simplified because the removing force is converted into the force working in the same direction as the operating force and then, transmitted to the switch portion.

The switch device may have an arrangement further comprising converting means for converting the removing force into a force working in the same direction as the operating force and transmitting the resultant force to the movable one of the first contact and the second contact.

According to the invention thus arranged, the arrangement of the switch device may be simplified because the removing force is converted into the force working in the same direction as the operating force and then, transmitted to the movable one of the first contact and the second contact.

The switch device may have an arrangement wherein the converting means is helically engaged with the pushbutton thereby converting the removing force applied by the turning motion into the force working in the same direction as the operating force and transmitting the resultant force to the switch portion.

According to the invention thus arranged, the arrangement of the switch device may be simplified even further because the converting means is helically engaged with the pushbutton.

The switch device may have an arrangement wherein the converting means is helically engaged with the pushbutton thereby converting the removing force applied by the turning motion into the force working in the same direction as the operating force and transmitting the resultant force to the movable one of the first contact and the second contact.

According to the invention thus arranged, the arrangement of the switch device may be simplified even further because the converting means is helically engaged with the pushbutton.

The switch device may have an arrangement wherein the pushbutton has a substantially cylindrical shape having a center axis extended in the same direction as the operating force, wherein the converting means comprises: a pushbutton support which is formed in a corresponding shape to that of the pushbutton and in a slightly larger size than that of the pushbutton, and in which the pushbutton is inserted; a projection formed on either one of a circumferential surface of the pushbutton and a circumferential surface of the pushbutton support; and a helical guide formed in the other circumferential surface as inclined relative to the center axis, and wherein the projection is engaged with the guide thereby converting the removing force into the force working in the same direction as the operating force.

According to the invention thus arranged, the projection is engaged with the guide thereby converting the removing force in turning motion into the force working in the same direction as the operation force and hence, the simple helical arrangement is adapted for the positive conversion of the removing force in turning motion into the force working in the same direction of the operating force.

The switch device may have an arrangement wherein the pushbutton has a substantially cylindrical shape having a center axis extended in the same direction as the operating force, wherein the converting means comprises: a pushbutton support which is formed in a corresponding shape to that of the pushbutton and in a slightly larger size than that of the pushbutton, and in which the pushbutton is inserted; a shaft connecting the movable one of the first contact and the second contact with the pushbutton support; a projection formed on either one of a circumferential surface of the pushbutton and a circumferential surface of the pushbutton support; and a helical guide formed in the other circumferential surface as inclined relative to the center axis, and wherein the projection is engaged with the guide thereby converting the removing force into the force working in the same direction as the operating force.

According to the invention thus arranged, the projection is engaged with the guide thereby converting the removing force in turning motion into the force working in the same direction as the operation force and hence, the simple helical arrangement is adapted for the positive conversion of the removing force in turning motion into the force working in the same direction of the operating force.

BEST MODES FOR CARRYING OUT THE INVENTION

FIG. 1 to FIG. 4 are fragmentary sectional views each showing an internal arrangement of a switch device according to an embodiment of the invention. The switch device shown in the figures is an emergency stop pushbutton switch.

The switch device comprises an operation portion a, and a switch portion b which are free to be mounted to or dismounted from each other. The operation portion a is a part which receives an operating force from an external source (such as an operator) and transmits the force to the switch portion b. The switch portion b is a part which receives the operating force from the operation portion a so as to open or close a respective pair of contacts based on the operating force. The switch portion is also referred to as a "contact portion" or a "contacting portion".

First, description is given of an arrangement of the operation portion a. The operation portion a comprises an operation body a1, and a pushbutton a3. The pushbutton a3 is substantially shaped like a circular cylinder. The pushbutton a3 receives the operating force from the external source at its top surface on one end side thereof. The other end of the pushbutton a3 is formed with a cylindrical projection a4 which projects from a side surface (circumferential surface) of the pushbutton a3. The operation body a1 is formed with two L-shaped guide grooves a2 at a lower part of a side surface thereof, the guide grooves allowing the operation body a1 to be turned and fitted in the switch portion b.

Figure 5:
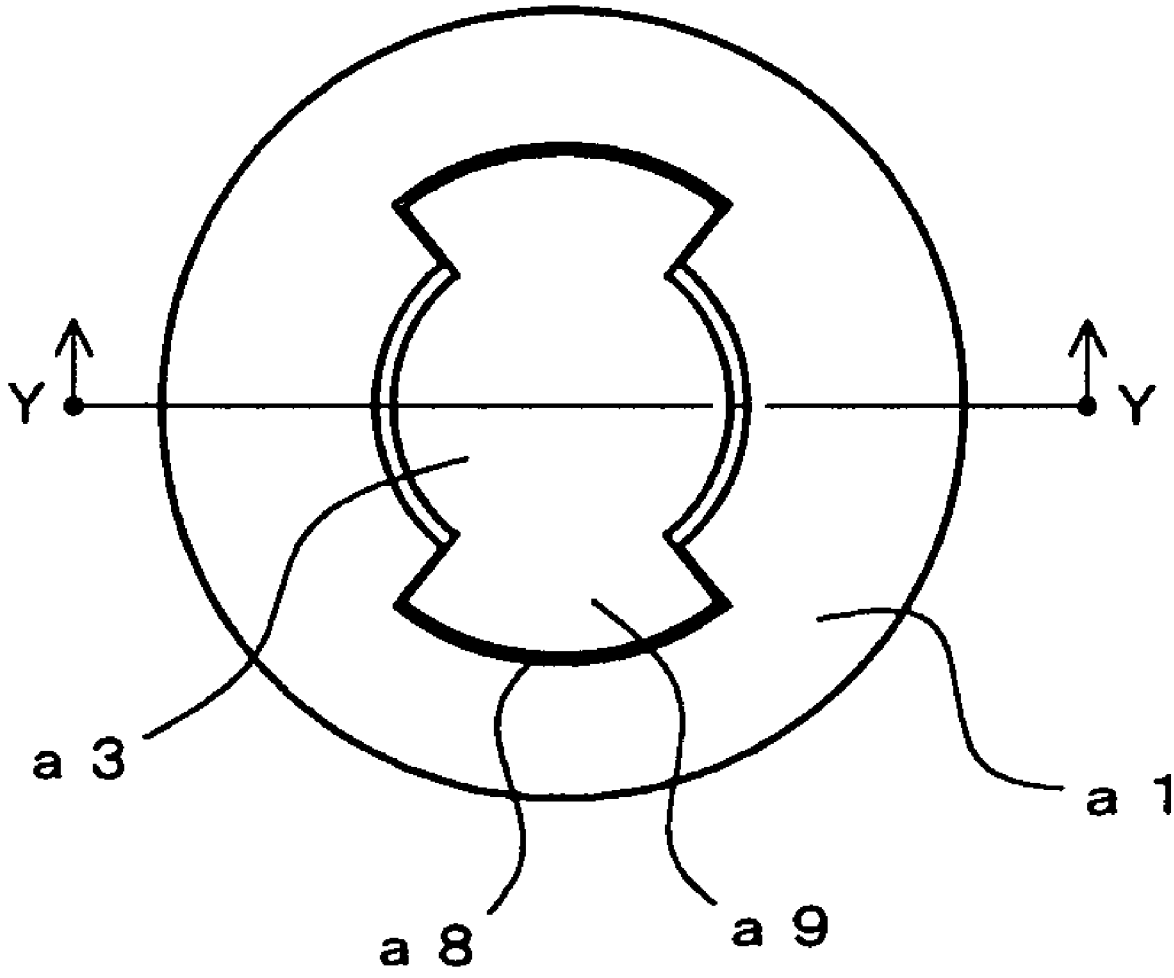
FIG. 5 is a plan view showing a top surface of an operation portion.
Figure 6:
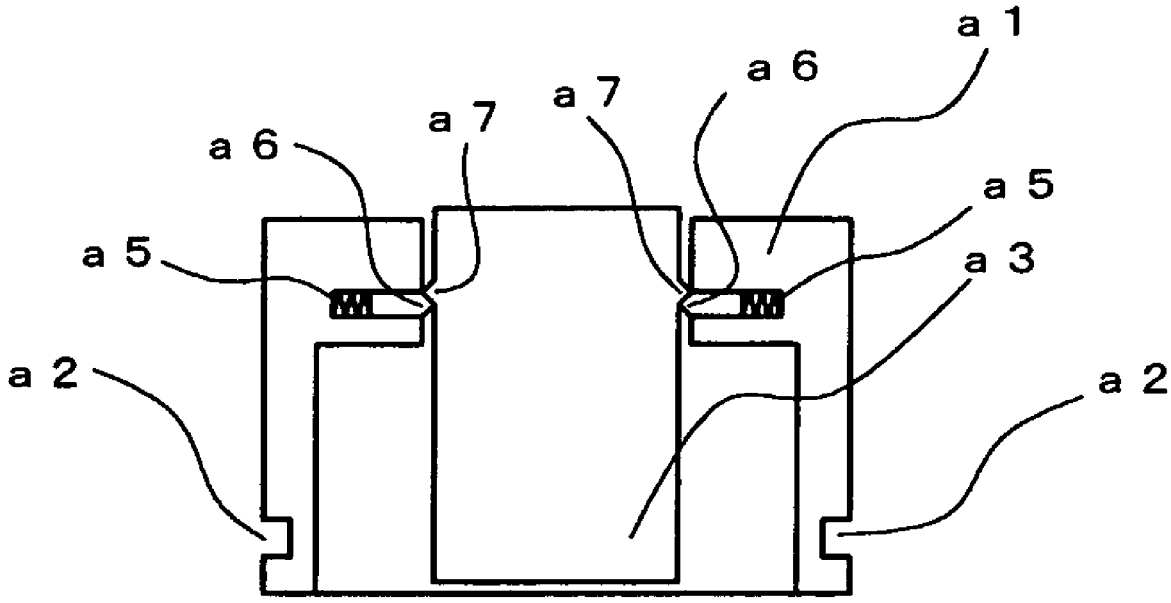
FIG. 6 is a sectional view taken on the line Y—Y in FIG. 5.

The operation portion a will be more specifically described with reference to FIG. 5 and FIG. 6. FIG. 5 is a plan view showing the top surface of the operation portion a, whereas FIG. 6 is a sectional view taken on the line Y—Y in FIG. 5. As shown in FIG. 5, the pushbutton a3 is formed with a fan-like projection a9 on the top-surface side thereof. The projection a9 is received in a fan-like recess a8 of the operation body a1. Thus, the pushbutton a3 is retained in a manner that when the operation body a1 is turned about a center axis X, the pushbutton a3 is also turned in conjunction with the turning of the operation body.

As shown in FIG. 6, a locking portion a6 is projected from an inside wall of the operation body a1 by means of an urging force of a spring a5, whereas a locking portion a7 is provided as projected from the side surface of the pushbutton a3. Thus, the pushbutton is retained in the following manner. When the operator presses down on the top surface of the pushbutton a3 along the center axis X with an operating force greater than a predetermined level, the pushbutton a3 receives this operating force to release the locking portions a6, a7 (see FIG. 6),so that the pushbutton is allowed to move downward along the center axis X.

Next, description is given of an arrangement of the switch portion b. The switch portion b includes: a switch body b1, a contact shaft b5, a coil spring b10, and terminal pieces b11. The switch body b1 is integrally formed with a partitioning/retaining portion b3, which horizontally extends to partition an internal space of the switch body b1. The partitioning/retaining portion b3 is centrally formed with a quadrangular through hole b4 extending therethrough along the center axis X. An inside wall of the switch body b1 is integrally formed with two engaging projections b2 at places upward from the partitioning/retaining portion b3, the engaging projections b2 designed to engage the guide grooves a2 of the operation portion a.

The contact shaft b5 has a quadrangular shape insertable through the through hole b4 and is inserted through the quadrangular through hole b4. Thus, the contact shaft b5 is retained in the switch body b1 in a manner to be free to move along the center axis X but inhibited from turning about the center axis X. A pushbutton support b6 is provided on an upper end of the contact shaft b5.

The pushbutton support b6 has a corresponding cylindrical shape to that of the pushbutton a3 and is slightly larger than the pushbutton. A distal end of the pushbutton a3 is inserted from above into the pushbutton support b6. A side surface (circumferential surface) of the pushbutton support b6 is formed with a guide b7 to be engaged with the projection a4. The guide b7 includes a slope b1 formed aslant relative to the center axis X. That is, the slope b71 is configured to extend from an operation-portion-a side toward a switch-portion-b side as winding about the center axis X (helical configuration) as shown in the figure.

A bridge piece b8 is mounted to a lower end of the contact shaft b5 at a mid-portion thereof. The bridge piece b8 is formed from a conductive material such as copper, and has movable contacts b9 attached to opposite ends thereof. The coil spring a10 is mounted to the contact shaft b5 at place between the bridge piece b8 and the partitioning/retaining portion b3, exerting an urging force directed to move the bridge piece b8 and the partitioning/retaining portion b3 away from each other.

Each of the two terminal pieces b11 has one end thereof exposed to outside of the switch body b1, and has a fixed contact b12 attached to the other end thereof. The terminal pieces b11 are disposed in a manner that the fixed contacts b12 oppose the movable contacts b9. The movable contacts b9 and the fixed contacts b12 are formed from a metal such as gold in order to reduce contact resistance. Such a metal is prone to be fused by the overcurrent or the like. In this embodiment, the operation portion a is assembled to a panel (not shown). According to the embodiment, either one of the movable contact b9 and the fixed contact b12 is equivalent to a "first contact" of the invention, whereas the other is equivalent to a "second contact" of the invention. Furthermore, the movable contact b9 is equivalent to "a movable one of the first contact and the second contact" according to the invention. On the other hand, the contact shaft b5 is equivalent to a "shaft member connecting the movable one of the first contact and the second contact with the pushbutton support" according to the invention.

Figure 1:
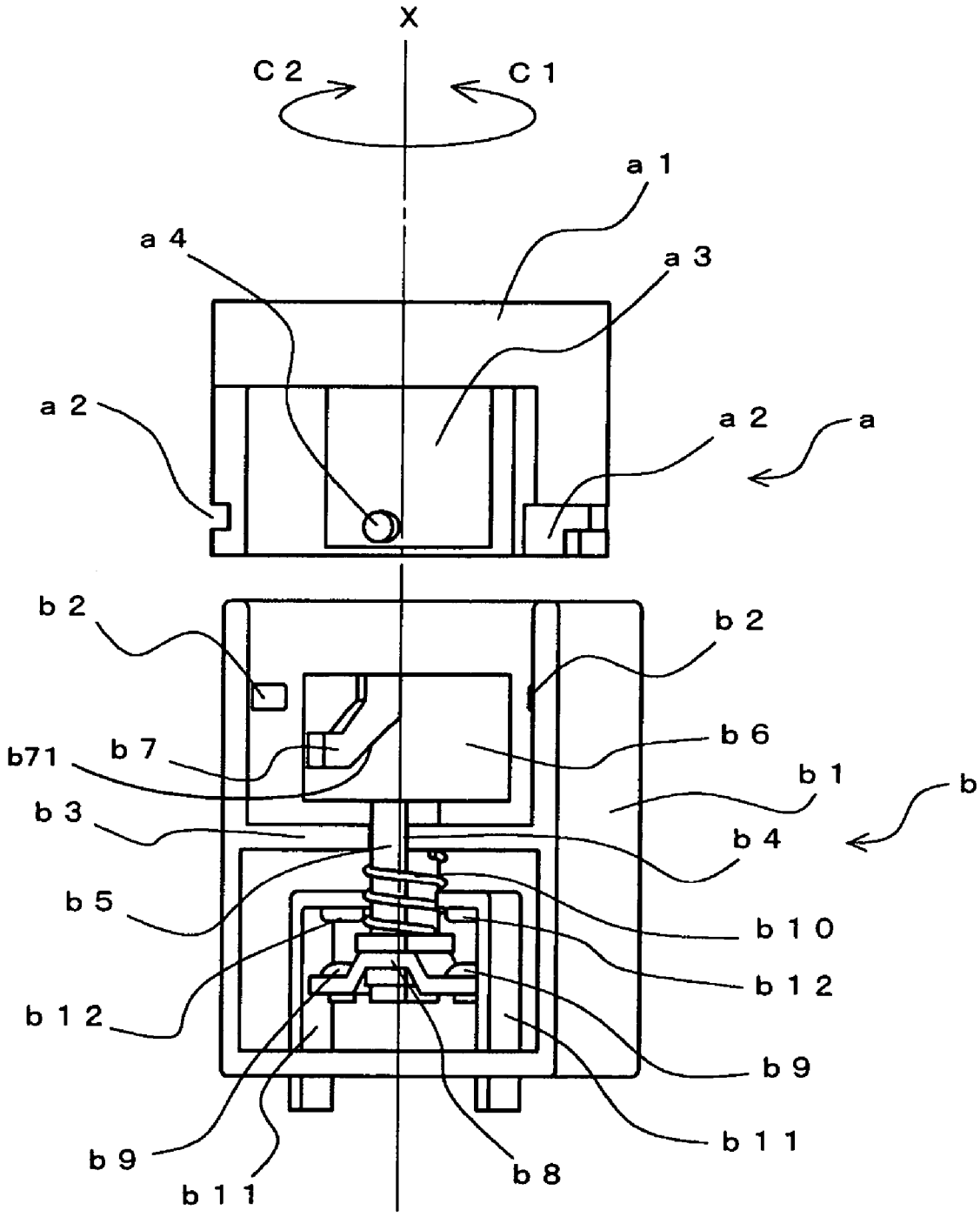
FIG. 1 is a fragmentary sectional view showing an internal arrangement of a switch device according to an embodiment of the invention.
Figure 2:
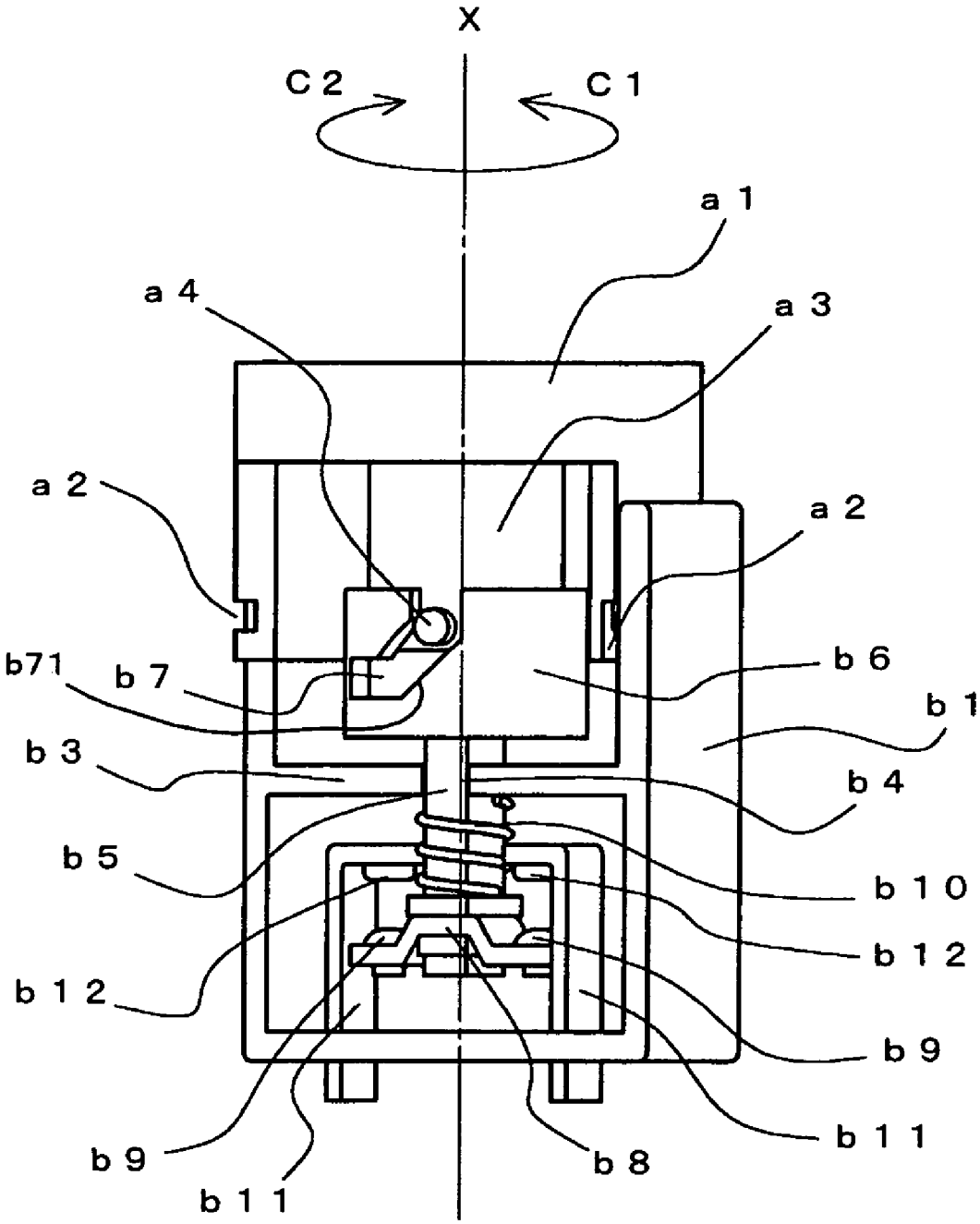
FIG. 2 is a fragmentary sectional view showing the internal arrangement of the switch device according to the embodiment of the invention.

Next, operations of the switch device are described. First, in the state of FIG. 1 where the switch portion b is dismounted from the operation portion a, the bridge piece b8 and the partitioning/retaining portion b3 are spaced away from each other by means of the coil spring b10, whereas the contact shaft b5 is moved downward so that the movable contacts b9 and the fixed contacts b12 are separated off from each other (open state). In this state, the operator inserts the engaging projections b2 into inlets of the guide grooves a2, and fits the switch portion b on the operation portion a from below in a manner to insert the projection a4 into an inlet of the guide b7 (FIG. 2).

Figure 3:
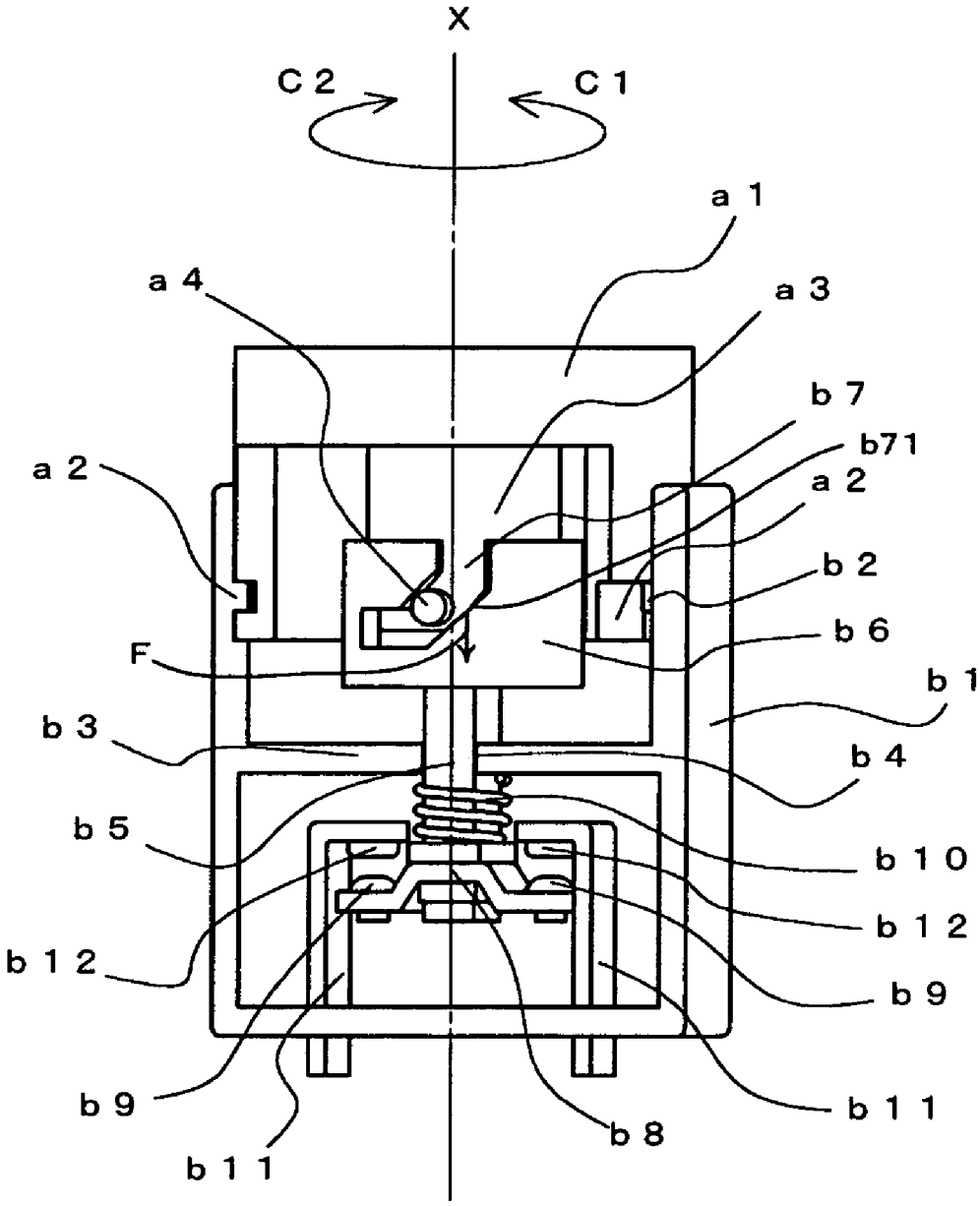
FIG. 3 is a fragmentary sectional view showing the internal arrangement of the switch device according to the embodiment of the invention.
Figure 4:
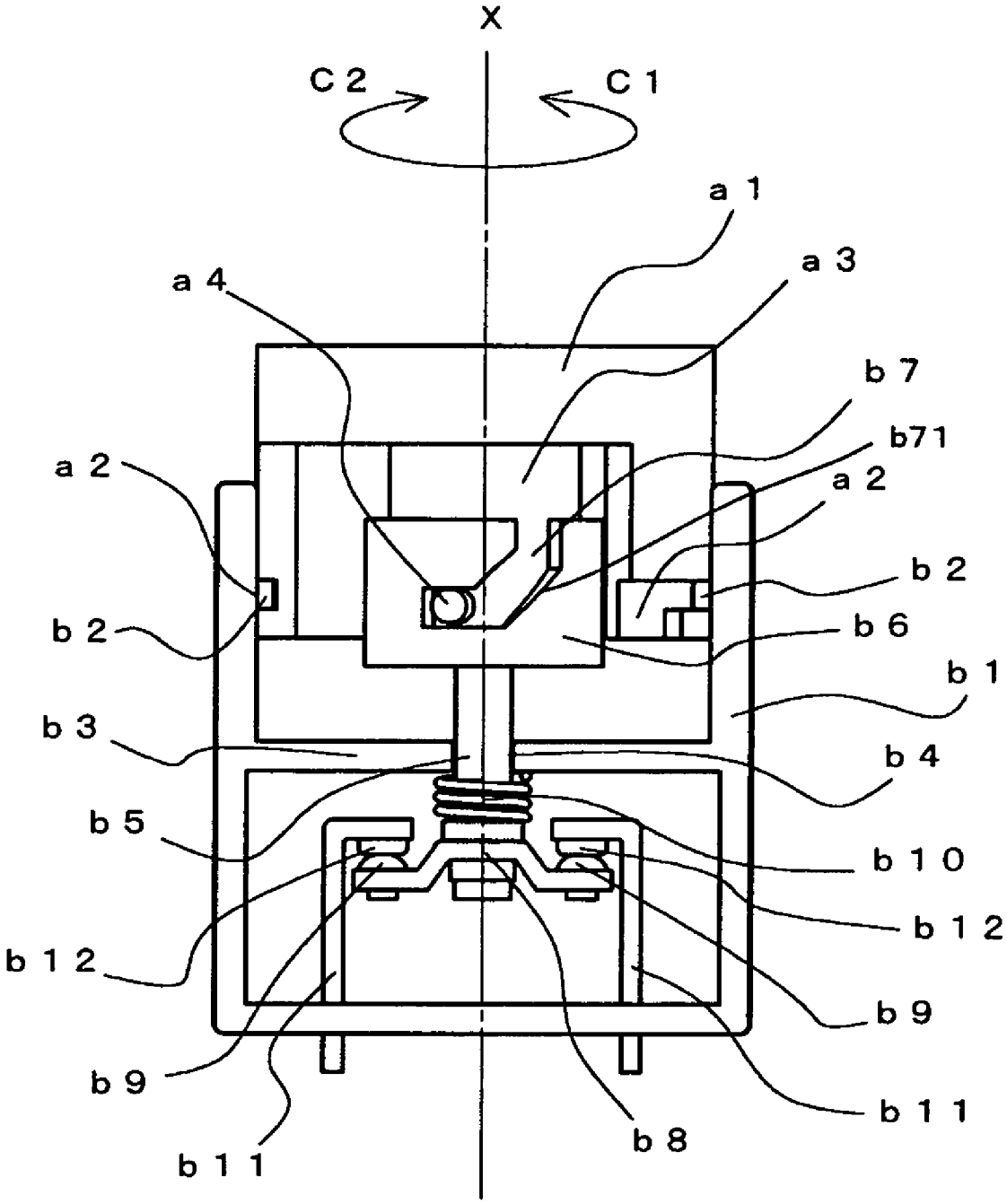
FIG. 4 is a fragmentary sectional view showing the internal arrangement of the switch device according to the embodiment of the invention.

Next, the operator turns the switch body b1 about the center axis X in a direction C1. As described above, the pushbutton a3 is so arranged as not to turn about the center axis X relative to the operation body a1. Accordingly, when the switch body b1 is turned in the direction C1, the projection a4 relatively moves in the helical guide b7. Thus, the projection a4 causes the pushbutton support b6 to move upward so that the movable contacts b9 are also moved upward, accordingly (FIG. 3). When the operator fully turns the switch body b1, the movable contacts b9 are brought into a state to contact the fixed contacts b12 (close state) (FIG. 4). In the aforementioned manner, the switch portion b is mounted to the operation portion a.

When the switch portion b is dismounted from the operation portion a, the steps to mount the switch portion b may be reversed. That is, in the state of FIG. 4 where the switch portion b is mounted to the operation portion a, the operator may apply a removing force to turn the switch portion b about the central axis X in the opposite direction C2.

When the switch portion b1 is turned, the projection a4 relatively moves in the helical guide b7 to move the pushbutton support b6 downward so that the movable contacts b9 are also moved downward accordingly to be brought into the state separated off from the fixed contacts b12 (open state) (FIG. 3). That is, when the operator applies the removing force to turn the switch portion b in the direction C2, the projection a4 abuts against the slope b71 so that the removing force as a reaction is applied to the slope. The removing force is divided into a component working along the slope b71 and a component F working in the same direction as the center axis X. Thus, the removing force is converted into a force F in the same direction as the center axis X. By means of the force F in the same direction as the center axis X, the pushbutton support b6 is moved downward as accordingly moving the movable contacts b9 away from the fixed contacts b12 vis the contact shaft b5.

The operator fully turns the switch body b1, so as to bring the engaging projections b2 and the projection a4 to the respective inlets of the guide grooves a2 and the guide b7 (FIG. 2). Then, the operator extracts the operation portion a upwardly from the switch portion b (FIG. 1). In this state, the coil spring b10 maintains the open state by applying the urging force to constantly separate the movable contacts b9 off from the fixed contacts b12.

As described above, the mounting force for mounting the switch portion b to the operation portion a or the removing force for dismounting the switch portion b from the operation portion a may be applied by the operator who applies the force to turn the switch body b1 of the switch portion b about a moving direction (the center axis X) of the pushbutton a3.

In the state where the switch portion b is mounted to the operation portion a, the switch device functions the same way as the well known emergency stop button switch. Specifically, when the operator presses down on the top surface of the pushbutton a3 along the center axis X with an operating force exceeding the predetermined level, the pushbutton retained in the state shown in FIG. 4, the pushbutton a3 receives this operating force so that the locking portions a6, a7 are disengaged (see FIG. 6) to allow the pushbutton a3 to move downward to transmit the operating force to the switch portion b. The switch portion b, in turn, receives the operating force from the operation portion a at the pushbutton support b6 thereof. The operating force moves the bridge piece b8 downward to separate the movable contacts b9 off from the fixed contacts b12 thereby establishing the open state. In order to return the switch device in this state to the initial state, the operator may pull the pushbutton a3 upward to bring the switch device back to the state shown in FIG. 4, where the movable contacts b9 and the fixed contacts b12 are placed in the close state.

As described above, the force for mounting/dismounting the switch portion b to/from the operation portion a, which is applied as turning the switch portion about the moving direction of the pushbutton a3, is converted into the force working in the moving direction of the pushbutton a3 by way of the engagement of the projection a4 with the helical guide b7. Then, the converted force causes the movable contacts b9 to move upward or downward. According to the embodiment, the pushbutton support b6, the contact shaft b5, the projection a4 and the guide b7 are equivalent to "converting means" of the invention.

According to the embodiment, in the switch device including the operation portion a and the switch portion b which are free to be mounted to/dismounted from each other, the removing force for dismounting the switch portion b from the operation portion a is utilized for separating the movable contacts b9 off from the fixed contacts b12. Therefore, even if the movable contacts b9 and the fixed contacts b12 are fused to each other, it is ensured that the movable contacts b9 can positively be separated off from the fixed contacts b12 by properly adjusting the aforesaid removing force. This affords the following advantage in a case where the embodiment is applied to the emergency stop pushbutton switch, for example. Even though the movable contacts b9 and the fixed contacts b12 are fused to each other, the machine tools or the like as the operation object can be maintained in a disabled state because in the state where the switch portion b is dismounted from the operation portion a, the movable contacts b9 are separated off from the fixed contacts b12.

According to the arrangement shown in the drawings, the pushbutton a3 is used for separating the movable contacts b9 off from the fixed contacts b12 when the switch portion b is dismounted from the operation portion a. However, an alternative arrangement as another embodiment may be made such that another member than the pushbutton a3 is used for separating the movable contacts b9 off from the fixed contacts b12. However, more preferred is the arrangement, as shown in the drawings, wherein the switch portion b is dismounted from the operation portion a by turning the switch portion b about the center axis X (the moving direction of the pushbutton a3). Such an arrangement leads to the simplification and downsizing of the structures of the operation portion a and the switch portion b.

Furthermore, the removing force imparted by the force in turning motion about the center axis X is converted by means of the pushbutton a3 into the force working in the same direction as the operating force, whereby the pushbutton a3 is permitted to transmit the removing force to the switch portion b the same way as the pushbutton a3 transmits the operating force to the switch portion b. This results in a simplified arrangement. Specifically, the projection a4 of the pushbutton a3 is helically engaged with the guide b7 of the pushbutton support b6 of the switch portion b, as shown in the drawings, thereby acting like a screw. Thus, quite a simple arrangement is adapted to convert the removing force imparted by the turning motion about the center axis X into the force working in the same direction as the operating force, such that the movable contacts b9 can be separated off from the fixed contacts b12.

When the operation portion a is mounted to on dismounted from the switch portion b, as shown in FIG. 1 to FIG. 4, the movable contacts b9 and the fixed contacts b12 are shifted between the open state and the close state. This permits an external system (not shown) electrically connected with the terminal pieces 11 to determine whether the operation portion a is mounted to the switch portion b or not.

It is to be noted that the invention is not limited to the foregoing embodiment and various changes and modifications other than the above may be made thereto unless such changes and modifications depart from the scope of the invention. For instance, the arrangement may be made, as described above, such that another member than the pushbutton a3 is used for transmitting the removing force for dismounting the operation portion a from the switch portion b, thereby separating the movable contacts b9 off from the fixed contacts b12.

While the drawings illustrate the switch device including the b-contacts (break contacts), the invention may also be applied to a switch device including a-contacts (make contacts). Furthermore, the invention may also be applied to other switch devices than the emergency stop pushbutton switch.

What is required is that the operation portion a and the switch portion b may be dismounted from each other. Hence, an arrangement may be made such that the operation portion a is assembled to the panel (not shown), as described above, whereas the switch portion b may be dismounted from the operation portion a by turning the switch portion b. Otherwise, the switch portion b may be assembled to the panel (not shown), whereas the operation portion a may be dismounted from the switch portion b by turning the operation portion a.

INDUSTRIAL APPLICABILITY

As described above, the invention is applicable to a variety of switch devices, such as an emergency stop pushbutton switch, wherein the operation portion externally operated and the switch portion are free to be mounted to or dismounted from each other, the switch portion including the first contacts and the second contacts allowed to be brought into or out of contact with each other.

The invention claimed is:

1. A switch device comprising:

an operation portion externally operated and a switch portion free to be mounted to or dismounted from each other; and the switch portion including a first contact and a second contact displaceable into or out of contact with each other, wherein a removing force externally applied for dismounting said operation portion and said switch portion from each other is transmitted to at least one of said first contact and said second contact to separate said first contact and said second contact off from each other.

2. A switch device according to claim 1, wherein said operation portion comprises a pushbutton which, when receiving an operating force externally applied thereto for opening or closing said first contact and said second contact, moves to transmit the operating force to said switch portion thereby effecting said opening or closing of the contacts, wherein said removing force is applied by turning either one of said operation portion and said switch portion about a moving direction of the pushbutton.

3. A switch device according to claim 2, further comprising converting means for converting said removing force into a force working in the same direction as said operating force and transmitting the resultant force to said switch portion.

4. A switch device according to claim 3, wherein said converting means is helically engaged with said pushbutton thereby converting said removing force applied by the turning motion into the force working in the same direction as said operating force and transmitting the resultant force to said switch portion.

5. A switch device according to claim 3, wherein said pushbutton has a substantially cylindrical shape having a center axis extended in the same direction as said operating force, wherein said converting means comprises: a pushbutton support which is formed in a corresponding shape to that of said pushbutton and in a slightly larger size than that of said pushbutton, and in which said pushbutton is inserted; a projection formed on either one of a circumferential surface of said pushbutton and a circumferential surface of said pushbutton support; and a helical guide formed in the other circumferential surface as inclined relative to said center axis, and wherein said projection is engaged with said guide thereby converting said removing force into the force working in the same direction as said operating force.

6. A switch device according to claim 1, wherein either one of said first contact and said second contact is designed to be movable in said switch portion, wherein said operation portion comprises a pushbutton which, when receiving an operating force externally applied thereto for opening or closing said first contact and said second contact, moves to transmit the operating force to the movable one of said first contact and said second contact thereby effecting said opening or closing of the contacts, and wherein the removing force is applied by turning either one of the operation portion and the switch portion about a moving direction of the pushbutton.

7. A switch device according to claim 6, further comprising converting means for converting said removing force into a force working in the same direction as said operating force and transmitting the resultant force to the movable one of said first contact and said second contact.

8. A switch device according to claim 7, wherein said converting means is helically engaged with said pushbutton thereby converting said removing force applied by the turning motion into the force working in the same direction as said operating force and transmitting the resultant force to the movable one of said first contact and said second contact.

9. A switch device according to claim 7, wherein said pushbutton has a substantially cylindrical shape having a center axis extended in the said direction as said operating force, wherein said converting means comprises: a pushbutton support which is formed in a corresponding shape to that of said pushbutton and in a slightly larger size than that of said pushbutton, and in which said pushbutton is inserted; a shaft member connecting the movable one of said first contact and said second contact with said pushbutton support; a projection formed on either one of a circumferential surface of said pushbutton and a circumferential surface of said pushbutton support; and a helical guide formed in the other circumferential surface as inclined relative to said center axis, and wherein said projection is engaged with said guide thereby converting said removing force into the force working in the same direction as said operating force.

10. A switch device comprising:

a switch assembly including a first contact and a second contact displaceable relative to each other to contact each other when at a first position and to move out of contact with each other when at a second position;

an operation device removably engageable with said switch assembly by displacement relative to said switch assembly effected by user applied installation and removal forces respectively of a removal operation and an installation operation, said operation device including a displaceable portion displaceable by a switching operation of a user and disposed in connection to at least said first contact to effect displacement of said first and second contact to said first and second positions in response to said switching operation; and said switch assembly including a force transmitting structure engaging said operation device and configured to apply said user applied removal force to at least said first contact to displace said first contact from said first position to a position whereat said first and second contacts are not in contact with each other.

11. The switch device accordingly to claim 10 wherein:

said first contact has a force transmitting member with a first engagement structure;

said displaceable portion has a second engagement structure engageable with said first engagement structure;

said first and second engagement structures being relatively displaceable by said user removal operation and configured to apply said user applied removal force to said first contact.

12. The switch device accordingly to claim 11 wherein said operation device and said switch assembly include mounting structures effecting mounting and dismounting of said operation device to said switch assembly at least in part by relative rotational motion of said operation device and said switch assembly effected by said installation and removal operations.

13. The switch device accordingly to claim 12 wherein said user removal operation on said operation device transmits rotation motion to said second engagement structure to rotationally move said second engagement structure relative to said first engagement and convert said rotation motion of said displaceable portion to a linear motion of said first engagement structure disengaging said first contact from said second contact.

14. The switch device accordingly to claim 13 wherein said displaceable portion is linearly displaceable relative said operation device and is rotationally restricted in motion relative said operation device such that said user removal operation on said operation device transmits said rotation motion to said second engagement structure.

15. The switch device accordingly to claim 14 wherein said displaceable portion is linearly displaced by said switching operation and transmits linear motion to said first engagement structure to linearly move said first engagement structure and thereby effect movement of said first and second contacts relative to each other to and from said first and second positions.

16. The switch device accordingly to claim 15 wherein one of said first and second engagement structures includes a spiral structure and another one of said first and second engagement structure includes a protrusion engaged with said spiral to effect conversion of said rotation motion of said displaceable portion to said linear motion of said first engagement structure disengaging said first contact from said second contact.

17. The switch device accordingly to claim 16 wherein said first engagement structure is connected to said first contact via said force transmitting member which is formed as a shaft member displaceably mounted in said switch assembly to permit said linear motion of said first engagement structure and to restrict rotational motion of said shaft member about an axis of said shaft member relative to said switch assembly.

18. The switch device accordingly to claim 11 wherein said first engagement structure is connected to said first contact via said force transmitting member which is formed as a shaft member displaceably mounted in said switch assembly to permit linear motion of said first engagement structure and to restrict rotational motion of said shaft member about an axis of said shaft member relative to said switch assembly.

19. The switch device accordingly to claim 10 wherein said operation device and said switch assembly include mounting structures effecting mounting and dismounting of said operation device to said switch assembly at least in part by relative rotational motion of said operation device and said switch assembly effected by said installation and removal operations.

20. The switch device accordingly to claim 19 wherein said displaceable portion is linearly displaceable relative said operation device and is rotationally restricted in motion relative said operation device such that said user removal operation on said operation device transmits said rotation motion to said displaceable portion.

* * * * *